United States Patent [19]

Hecht

[11] Patent Number: 4,688,371

[45] Date of Patent: Aug. 25, 1987

[54] APPARATUS FOR FILLING FLEXIBLE BULK MATERIAL CONTAINERS

[76] Inventor: Günther Hecht, Dr.-Scharl-Strasse 8, D-8068 Pfaffenhofen/Ilm, Fed. Rep. of Germany

[21] Appl. No.: 841,525

[22] PCT Filed: Jul. 4, 1985

[86] PCT No.: PCT/EP85/00325

§ 371 Date: Mar. 4, 1986

§ 102(e) Date: Mar. 4, 1986

[87] PCT Pub. No.: WO86/00594

PCT Pub. Date: Jan. 30, 1986

[30] Foreign Application Priority Data

Jul. 4, 1984 [DE] Fed. Rep. of Germany ..... 3424613

[51] Int. Cl.[4] ..... B65B 1/32; B65B 1/28

[52] U.S. Cl. ..... 53/502; 53/570; 141/83; 141/285

[58] Field of Search ..... 53/502, 570, 167; 141/83, 114, 285, 301, 314, 388

[56] References Cited

U.S. PATENT DOCUMENTS

| | | | |
|---|---|---|---|
| 2,524,560 | 10/1950 | Cote | 141/285 X |
| 2,853,105 | 9/1958 | Brown | 141/285 |
| 3,128,837 | 4/1964 | Gibbons . | |
| 3,416,620 | 12/1968 | McClusky | 53/502 X |
| 4,182,386 | 1/1980 | Alack | 141/83 |
| 4,235,067 | 11/1980 | Parsons | 53/502 |
| 4,249,361 | 2/1981 | Tetenborg et al. | 53/570 X |
| 4,407,108 | 10/1983 | Craig | 53/502 X |

*Primary Examiner*—Horace M. Culver

*Attorney, Agent, or Firm*—Sixbey, Friedman & Leedom

[57] ABSTRACT

The present invention relates to an apparatus for filling flexible bulk material containers (8), having a balance (1) mounted in the upper area of a standing frame (20) or on a hanging frame, upper carrying means (5) suspended on the load receiving member (2) of the balance for hanging a flexible bulk material container in an upper area thereof, lower carrying means (7) for supporting the flexible bulk material container from below suspended on the load receiving member of the balance, a hoisting mechanism (3) fitted to the load receiving member of the balance for the upper and lower carrying means for moving same between a position in which the lower carrying means is in contact with the ground and a position in which the lower carrying means is raised from the ground, and a filling tube (12) fitted to the load receiving member of the balance for filling the flexible bulk material container from above.

11 Claims, 2 Drawing Figures

APPARATUS FOR FILLING FLEXIBLE BULK MATERIAL CONTAINERS

Figure 2:
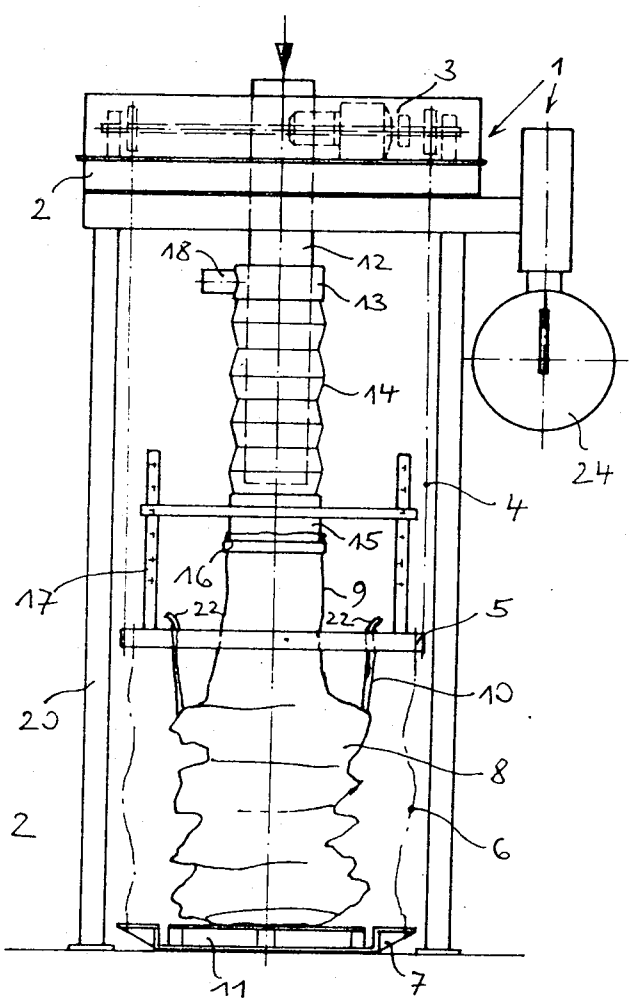

The invention relates to an apparatus for filling flexible bulk material containers.

In the case of conventional apparatuses for filling sacks, bags and the like involving the weighing of the introduced bulk material quantity, the scales or balance is either set up on the ground or is embedded in the latter. In the first case, as a result of the overall height of the balance, it is generally necessary to use an expensive forklift for removing the heavy, filled bulk material container standing thereon. In the second case, as a result of the gaps caused by the balance embedded in the floor or ground, it is difficult to clean the filling apparatus and the surrounding floor area, this being particularly disadvantageous when it is necessary to operate under hygienically completely satisfactory conditions.

The problem of the invention is to obviate this shortcoming and provide a filling apparatus for flexible bulk material containers enabling the container to be removed after filling by simple means, e.g. a hand truck, without there being any need for a balance sunk into the ground.

The present invention therefore proposes an apparatus for filling flexible bulk material containers, having a balance mounted in the upper area of a standing frame or on a hanging frame, upper carrying means suspended on the load receiving member of the balance for hanging a flexible bulk material container in an upper area thereof, lower carrying means for supporting the flexible bulk material container from below suspended on the load receiving member of the balance, a hoisting mechanism fitted to the load receiving member of the balance for the upper and lower carrying means for moving same between a position in which the lower carrying means is in contact with the ground and a position in which the lower carrying means is raised from the ground, and filling tube fitted to the load receiving member of the balance for filling the flexible bulk material container from above.

For filling purposes, by means of the hoisting mechanism the upper and lower carrying means with the bulk material container hanging or supported thereon are raised to such an extent that the lower carrying means no longer stand on the ground. In this suspended state, the bulk material container is filled through the filling tube, to which the container is fixed by its filling opening or connection and the filled quantity is measured by means of the balance.

After filling, the upper and lower carrying means are lowered against by means of the hoisting mechanism until the lower carrying means rest on the ground, after which the filled bulk material container can be removed from the filling apparatus by means of a simple hand truck due to the possible low overall height of the lower carrying means. Since, during filling, the bulk material container was supported from below by the lower carrying means, an outward bulging of the container in the downwards direction during filling is avoided, so that after removal from the filling apparatus, the bulk material container can stand in unsupported manner.

According to a preferred development of the invention, the filling apparatus also has a length-variable tubular element traversed by the filling tube and which is fixed to the latter in the vicinity of its balance-side end and is fixed to the upper carrying means and can be connected the bulk material container to be filled in the vicinity of its bulk material container-side end.

As a result, the connection of the filling opening or connection of the bulk material container to the filling apparatus always takes place at a normal grasping or gripping height and the detachment thereof after filling often takes place at said height, without it being necessary to provide a special platform; this being made possible by an adequate lowering of the upper carrying means using the hoisting mechanism. With regards to detachment, this even applies in the case of flexible bulk material containers which are higher than a man, because in the case of an adequate lowering of the upper carrying means by the hoisting mechanism, they partly collapse into themselves or can be compressed in the upper region because the filling tube, whose lower end determines the maximum filling height, always projects by a certain length into the interior of the container, so that above the filling tube end the container remains empty.

To adapt to different constructions or lengths of the flexible bulk material container filling connection, according to a preferred development of the invention, the fixing of the length-variable, tubular element to the upper carrying means takes place with vertical adjustability of the bulk material container-side end of the tubular element with respect to the upper carrying means.

According to a further preferred development of the invention, the length-variable, tubular element comprises a bellows, which in simple manner combines the length variability with the necessary dust tightness.

According to another preferred development of the invention, between the filling tube and the tubular element surrounding it an annular space is provided, into which issues a vent branch passing through the tubular element. As a result of this vent branch, the air driven out by the bulk material can escape from the bulk material container. In the case of a suitable connection of the vent branch, e.g. to an extractor fan with dust removal filter, this simultaneously ensures that bulk material entrained with the escaping air does not contaminate the area surrounding the filling apparatus.

Figure 1:
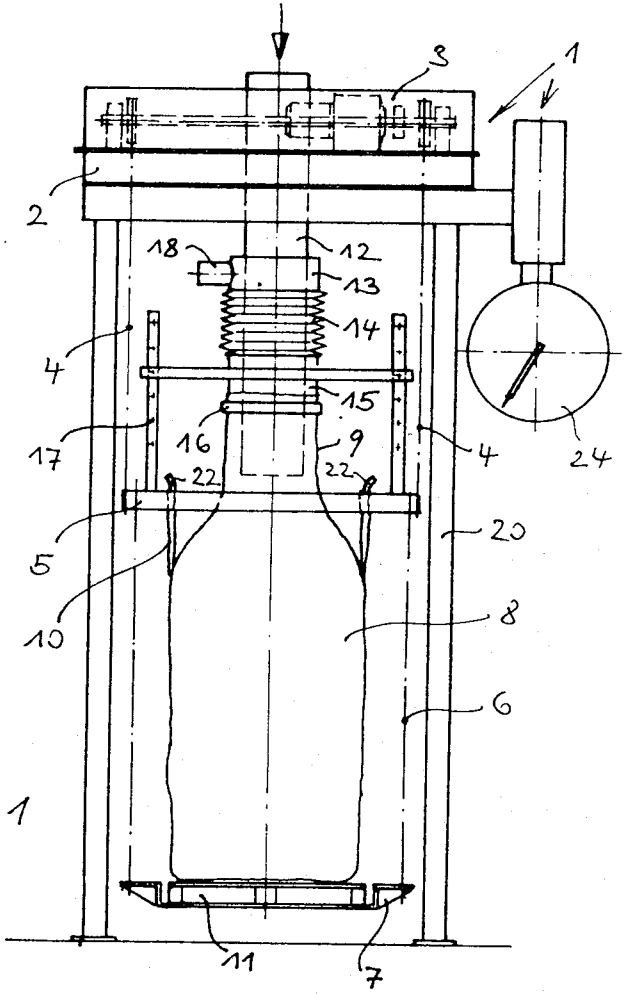

A preferred embodiment of the invention is described in greater detail hereinafter relative to the drawings, wherein show:

FIG. 1 The apparatus in a state during the filling of the bulk material container.

FIG. 2 The apparatus in a position for removing a filled bulk material container or for fitting a container to be filled.

According to FIGS. 1 and 2, the apparatus for filling flexible bulk material containers has a balance 1 fitted at the top to a frame 20 standing on the floor or ground and provided with a circular weight indicating dial 24 and on whose load receiving member or load carrying part 2 is constructed an electrical hoisting mechanism 3. On the latter is suspended on wire ropes 4 an upper supporting frame 5, on which is hung a lower supporting frame 7 by means of further wire ropes or chains 6.

A bulk material container 8 having a filling connection 9 is hung in its upper region with the aid of loops 10 to hooks 22 provided on the upper supporting frame 5 and its bottom is directly placed on the lower supporting frame 7, or is indirectly placed thereon via a pallet 11.

Roughly centrally with respect to the two supporting frames, a vertical filling tube 12 is fitted to the load carrying part 2 of balance 3 and enables the bulk material, for instance from a storage container, to be filled into the flexible bulk material container and which is vertically adjustable to adapt to different container sizes or filling connection dimensions. In the central region of filling tube 12, the upper end of a bellows 14 surrounding the filling tube is fixed, e.g. welded, to the filling tube through a ring 13 in dust-tight manner. At the lower end of the bellows is provided a pipe connection 15, to which can be fixed the filling connection 9 of the bulk material container 8, e.g. with the aid of a quick-action sack or bag clamp 16.

The upper supporting frame 5 has a reception structure 17 for the pipe connection 15 of the bellows 14, by means of which connection 15 can be connected to the upper supporting frame 5. A lowering and raising of the upper supporting frame 5 then brings about an expansion or contraction of bellows 14. The reception structure 17 for the pipe connection 15 is vertically adjustable to adapt to different filling connection dimensions of the bulk material container with respect to the upper supporting frame 5. Ring 13 has a vent branch 18, which issues into an annular area provided between filling tube 12 and bellows 14 and by means of which it is possible to remove the air displaced from the bulk material container by the bulk material during the filling process. On connecting the vent branch, e.g. via a hose, to an extractor fan with dust filter, it is also possible to ensure dust-free working without contaminating the area surrounding the filling station.

In the filling and weighing state of the apparatus shown in FIG. 1, the two supporting frames 5, 7 have been raised through the wire ropes 4 and wire ropes or chains 6 to such an extent by means of the electrical hoisting mechanism, which is formed by a cable winch operated by an electric motor, that also the lower supporting frame 7 is freely suspended. The length of the wire ropes or chains 6 is variable and through correspondingly adapting this length, it is ensured that in the raised state the container suspended on the upper supporting frame 5 rests in about stretched form on the lower supporting frame 7, either directly or indirectly via pallet 11.

In the container change position before or after filling the flexible bulk material container shown in FIG. 2, with the aid of the hoisting mechanism 3 supporting frames 5, 7 are lowered. The lower supporting frame 7 rests on the ground and the upper supporting frame 5, whilst stretching bellows 14, is so low that the fixing point of the bulk material container 8 to the pipe connection 15 can easily be reached from the ground. In this position, when removing a filled bulk material container, the loops 10 are also tension-relieved, so that they can be easily detached from the hooks 22 of the upper supporting frame 7 and the container can be removed from the flat lower supporting frame 7, e.g. using a simple sack truck.

In an embodiment of the filling apparatus without bellows or length-variable tubular element, the filling cap 9 of the bulk material container 8 is fixed by means of a quick-action sack clamp 16 directly to filling tube 12. This means that an operator, in certain circumstances with the aid of a platform, must detach the filling cap 9 from the filling tube 12 before a filled bulk material container 8 can be lowered by means of the hoisting mechanism 3. Moreover, an empty bulk material container to be filled must already be installed at the height of filling tube 12 at which the fixing point is to be located during the filling process.

What is claimed is:

1. Apparatus for the filling and weighing of bulk material containers comprising a standing frame; a weighing balance mounted at the upper area of said standing frame, said balance having a load receiving member; a hoisting mechanism fitted upon the load receiving member of said balance; an upper carrying means suspended from said hoisting mechanism in such a manner that said hoisting mechanism serves as a means for raising and lowering said upper carrying means relative to said balance; a tubular container connection element connected to said upper carrying means, said connection element serving as a means for fixing a filling connection of a bulk material container; a filling tube fitted to the load receiving member of the balance and extending vertically relative thereto in order to enable filling of a container disposed below said balance from thereabove; dust-tight means for interconnecting an outlet end of said filling tube with said connection element in a manner enabling relative vertical displacement of said connection element with respect to said filling tube as the position of said upper carrying means is adjusted relative to said balance by said hoisting mechanism; a lower carrying means for supporting a bulk material container thereon; and flexible means, interconnecting said lower carrying means with said upper carrying means, for raising and lowering said lower carrying means, in a manner suspended from said upper carrying means, between a position in which said lower carrying means is supported on the ground and positions wherein said lower carrying means is out of engagement with the ground and for enabling relative displacement between said upper and lower carrying means when said lower carrying means is supported on the ground.

2. Apparatus according to claim 1, wherein said dust-tight means is adjustable in length.

3. Apparatus according to claim 2, wherein an end of said dust-tight means by which it is connected to said connection element is vertically displaceable over said filling tube.

4. Apparatus according to claim 1, wherein said dust-tight means comprises a bellows.

5. Apparatus according to claim 4, wherein an end of said dust-tight means by which it is connected to said connection element is vertically displaceable over said filling tube.

6. Apparatus according to claim 1, wherein an annular space is formed between the filling tube and the dust-tight means, and wherein a vent means communicates with said annular space for venting air displaced from said bulk material container during filling thereof.

7. Apparatus according to claim 1, wherein the length of said flexible means is adjustable.

8. Apparatus according to claim 2, wherein the height of said connection element relative to said upper carrying means is adjustable.

9. Apparatus according to claim 3, wherein said dust-tight means is adjustable in length.

10. Apparatus according to claim 9, wherein an end of said dust-tight means by which it is connected to said connection element is vertically displaceable over said filling tube.

11. Apparatus according to claim 1, wherein the height of said connection element relative to said upper carrying means is adjustable.

* * * * *